US007712420B2

(12) United States Patent
Scott et al.

(10) Patent No.: US 7,712,420 B2
(45) Date of Patent: May 11, 2010

(54) CAB ISOLATION SYSTEM FOR A LOCOMOTIVE

(75) Inventors: Robert Thomas Scott, Shorewood, IL (US); Xiangling Zhang, Hinsdale, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 0 days.

(21) Appl. No.: 11/943,261

(22) Filed: Nov. 20, 2007

(65) Prior Publication Data

US 2009/0013900 A1 Jan. 15, 2009

Related U.S. Application Data

(60) Provisional application No. 60/866,546, filed on Nov. 20, 2006.

(51) Int. Cl.
*B61C 17/04* (2006.01)

(52) U.S. Cl. ..... 105/342; 105/456; 105/392.5; 105/453

(58) Field of Classification Search ..... 105/342, 105/456; 180/89.19
See application file for complete search history.

(56) References Cited

U.S. PATENT DOCUMENTS 4,596,194 A * 6/1986 Paton ..... 105/199.3
5,520,259 A * 5/1996 Onohara et al. ..... 180/89.12
5,553,911 A * 9/1996 Bodin et al. ..... 296/190.07
5,941,920 A 8/1999 Schubert
6,360,672 B1 * 3/2002 Detar ..... 105/26.05
7,077,226 B2 7/2006 Oliver et al.
7,240,754 B2 * 7/2007 Barta et al. ..... 180/89.12
2006/0131801 A1 * 6/2006 Barickman et al. ..... 267/293

* cited by examiner

*Primary Examiner*—S. Joseph Morano
*Assistant Examiner*—Zachary Kuhfuss
(74) *Attorney, Agent, or Firm*—Eugene M. Cummings, P.C.

(57) ABSTRACT

Provided is a cab isolation system for a locomotive is provided including a cab having a front and a rear. The cab isolation system further includes a pivot located generally near the rear of the cab and at least one spring generally located near the front of the cab. In another embodiment, dampers may further be provided and generally located near the front of the cab. In another embodiment, lateral links may further be provided and generally located near the front of the cab. This system may include any of the above elements, alone or in combination, to provide for a cab isolation system for isolating a locomotive cab from engine generated structure borne noise and vibration, while lower frequency track induced motions are not magnified.

20 Claims, 15 Drawing Sheets

CAB ISOLATION SYSTEM FOR A LOCOMOTIVE

CROSS-REFERENCE TO RELATED APPLICATIONS

This application claims benefit under 35 U.S.C. §119(e) of U.S. Provisional Application Ser. No. 60/866,546, entitled "Cab Isolation System for a Locomotive," filed Nov. 20, 2006, naming Robert Thomas Scott and Xiangling Zhang as inventors, the complete disclosure thereof being incorporated herein by reference.

BACKGROUND OF THE INVENTION

The present invention generally relates to a locomotive cab and, more specifically to a cab isolation system for a locomotive.

Locomotives traditionally include cab isolation systems generally having four rubber mounts at each corner of the locomotive cab. These cab isolation systems generally work well for engine induced structure borne noise. However, these traditional systems are sensitive to engine induced vibration and to track induced low frequency motions.

Some traditional highway trucks include a cab isolation system that is dependent on a front rubber bushing pivot and rear spring and damper combination, rather than four rubber mounts as implemented in traditional locomotive cab isolation systems. These cab isolation systems for highway trucks may or may not use links to control other modes of vibration. Although this type of system is generally acceptable for highway trucks, a cab isolation system including a front pivot would not work in a locomotive because locomotives cabs are situated near the front end of the locomotive where the largest motions exist. This is especially true for the first bending natural frequency of the underframe structure and at lower frequencies. Therefore, if traditional highway truck cab isolation systems were implemented into locomotive cabs, a large portion of these motions would be passed directly into the cab, thereby causing the cab to be overly sensitive to track induced low frequency motions.

Accordingly, the use of a front pivot for cab isolation systems for locomotives have been traditionally rejected for the more traditional cab isolation system having four rubber mounts at each corner of the locomotive cab.

It is therefore an object of the present invention to reduce the locomotive cab's sensitivity to engine induced vibration and to track induced low frequency motions while still maintaining cab isolation to engine induced structure borne noise. It is further an object of the present invention to provide a cab isolation system for a locomotive cab including a pivot generally located at the rear of a locomotive cab.

This and other desired benefits of the preferred embodiments, including combinations of features thereof, of the invention will become apparent from the following description. It will be understood, however, that a process or arrangement could still appropriate the claimed invention without accomplishing each and every one of these desired benefits, including those gleaned from the following description. The appended claims, not these desired benefits, define the subject matter of the invention. Any and all benefits are derived from the multiple embodiments of the invention, not necessarily the invention in general.

SUMMARY OF THE INVENTION

In accordance with the invention, a cab isolation system is provided for a locomotive including a cab having a front and a rear. The cab isolation system generally includes a pivot located generally near the rear of the cab and at least one spring generally located near the front of the cab. In another embodiment, dampers may further be provided and generally located near the front of the cab. In another embodiment, lateral links may further be provided and generally located near the front of the cab. This system is generally acceptable as the node for the first bending natural frequency for a locomotive is generally located near the rear of the cab.

It should be understood that the present invention includes a number of different aspects or features which may have utility alone and/or in combination with other aspects or features. Accordingly, this summary is not exhaustive identification of each such aspect or feature that is now or may hereafter be claimed, but represents an overview of certain aspects of the present invention to assist in understanding the more detailed description that follows. The scope of the invention is not limited to the specific embodiments described below, but is set forth in the claims now or hereafter filed.

DETAILED DESCRIPTION OF THE INVENTION

Figure 1:
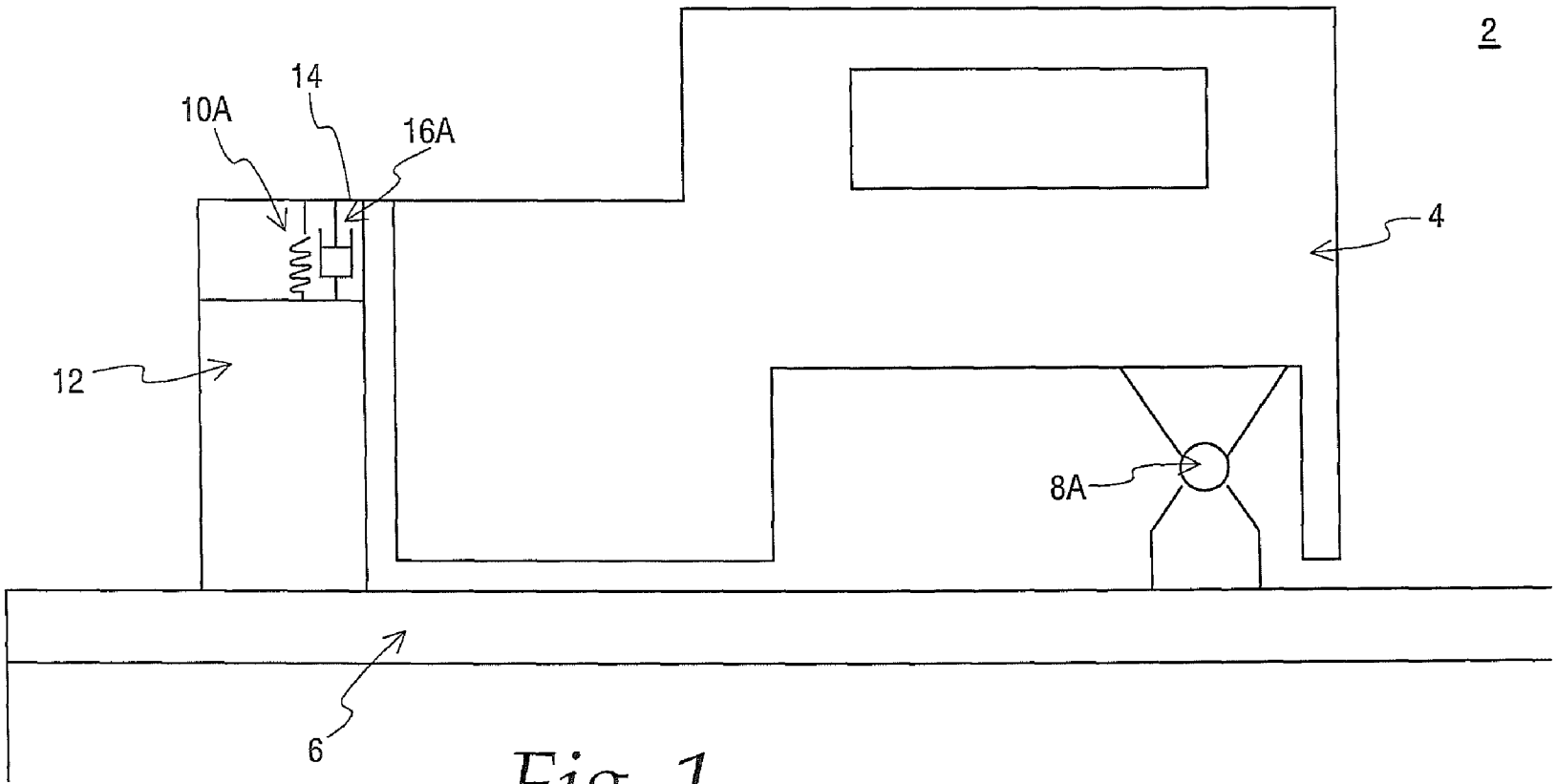
FIG. 1 is a conceptual illustration of a side view of a cab isolation system in accordance with an embodiment of the present invention.
Figure 2:
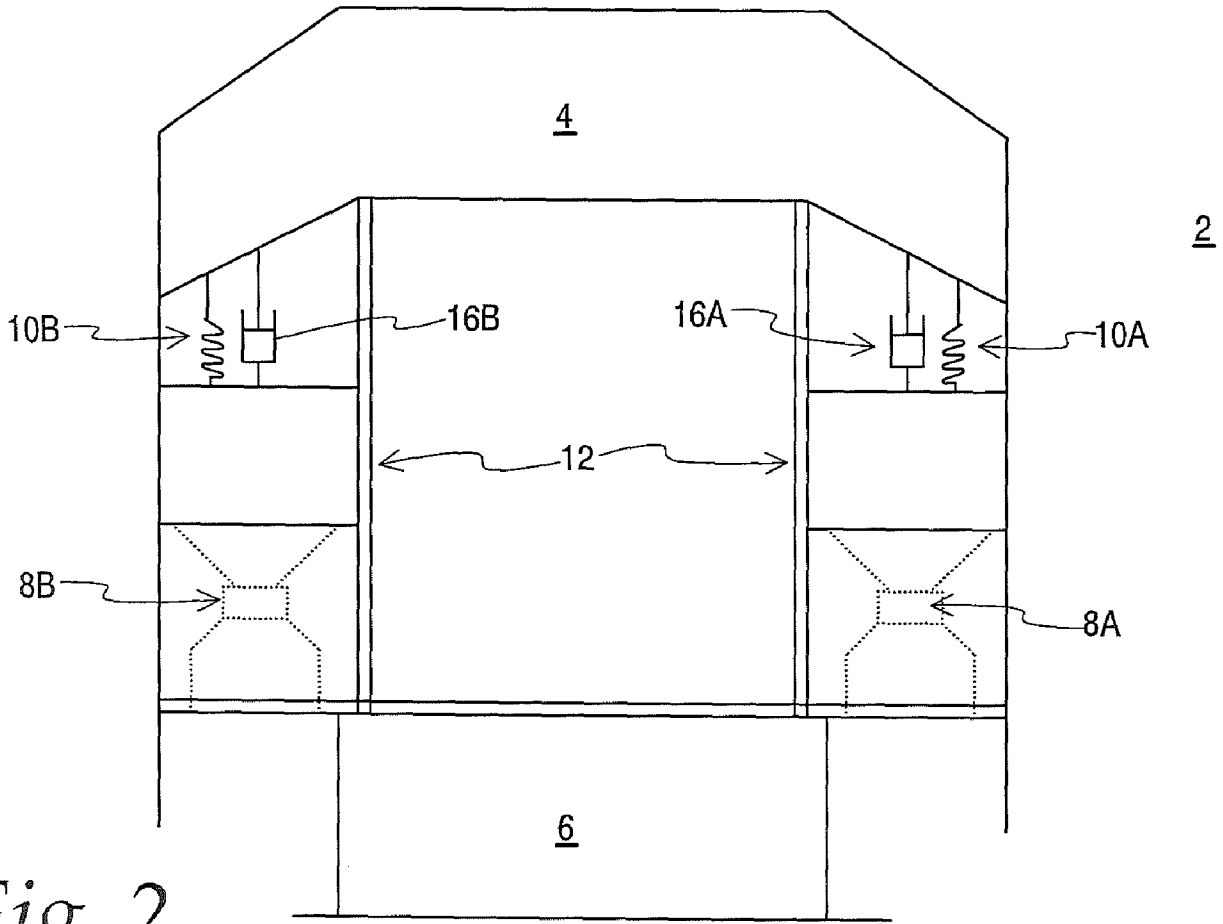
FIG. 2 is a front view of the cab isolation system of FIG. 1.

The present invention generally relates to a cab isolation system for a locomotive. As shown in FIGS. 1 and 2, the locomotive 2 generally includes a cab 4 situated above an underframe 6. The cab 4 is generally constructed of a sealed steel and glass construction in order to provide for a sufficient barrier to air-borne noise from outside the cab 4. The cab 4 is constructed such that is provides a barrier to about 40 dB (A) of air-borne noise from outside the cab 4.

A cab isolation system is provided which separates the cab 4 from the underframe 6. This arrangement reduces engine induced structure-borne noise and higher frequency vibration in the cab 4. Included in the cab isolation system is at least one pivot generally located near the rear of the cab 4. In the embodiments shown in FIGS. 1 and 2, a pair of rear pivots 8*a*, 8*b* pivotally mounts the rear of the cab 4 to the underframe 6. The rear pivots 8*a*, 8*b* may be in the form of rubber bushings. The rear pivots 8*a*, 8*b* may also be selected to control the frequency and magnitude of vertical, lateral, and longitudinal natural frequencies near the rear of the cab 4. The orientation of the axle of the rear pivots 8*a*, 8*b* may be determined by vertical, lateral, and longitudinal stiffness requirements of the isolation and the radial, torsional, and axial stiffness of the rear pivots 8*a*, 8*b* themselves. The torsional stiffness of the rear pivots 8*a*, 8*b* may be chosen to further facilitate a low cab pitching natural frequency.

In one embodiment, the rear pivot 8 is selected to be relatively stiff in the vertical, lateral, and longitudinal directions, but relatively soft in the rotation direction. This arrangement would allow the cab 4 to pitch. In another embodiment, a single rear pivot may be provided instead of a pair of rear pivots 8*a*, 8*b* as shown in FIGS. 1 and 2.

In another aspect of the present invention, in order to control the pitch of the cab 4, further included in the cab isolation system is at least one spring generally located near the front of the cab 4. In one embodiment, front springs may be oriented vertically at each corner of the front of the locomotive cab 4. The spring may be in the form of any kind of spring (e.g., steel spring, coil spring, leaf spring, airbag, rubber pad, or any other comparable spring). The primary function of the spring is to maintain a low cab pitch natural frequency. For example, the front spring may maintain a low cab pitch natural frequency relatively low as compared to the locomotive underframe 6 first bending natural frequency. In another embodiment, the spring may control motion vertically.

In one embodiment of the present invention, as shown in FIGS. 1 and 2, front springs 10*a*, 10*b* are shown located in a short hood 12 situated in front of the cab 4. The short hood 12 is shown to be mounted on the locomotive underframe 6. The front springs 10*a*, 10*b* are mounted in the short hood 12 and operatively engages the cab 4 via a link 14. In this arrangement, the pitch natural frequency is set by the front springs 10*a*, 10*b* between the front wall of the cab 4 and the rear of the short hood 12. The spring stiffness is set to establish a cab pitch frequency which is above most of the bogie suspension frequencies and the primary track input frequencies, but below underframe first bending. This arrangement provides isolation from the first bending of the underframe, which is typically about 5.2 Hz. In one example, the spring stiffness is set to establish a cab pitch frequency of about 3.5 Hz.

In yet another aspect of the present invention, further included in the cab isolation system is at least one damper located near the front of the locomotive cab 4. The dampers may be in the form of vertical dampers which act in parallel to the front springs. In one aspect of the present invention, the front springs may be adapted to serve as dampers. For example, the front springs may comprise a material that has sufficient damping. The dampers may generally serve to reduce or eliminate magnification of low frequency motions such as those typically generated by the response of the locomotive suspension and the cab to track induced forces.

In one embodiment of the present invention, as shown in FIGS. 1 and 2, a pair of dampers 16*a*, 16*b* are shown located in the short hood 12 and situated near the front springs 10*a*, 10*b*. The short hood 12 is shown to be mounted on the locomotive underframe 6. The dampers 16*a*, 16*b* are mounted in the short hood 12 and operatively engage the cab 4 via the link 14. In this arrangement, damping is provided to limit magnification of low frequency suspension modes (typically about 1.5 to about 2 Hz), and to prevent excessive magnification of the 3.5 Hz cab pitch, should there be any excitation at that frequency.

Figure 3:
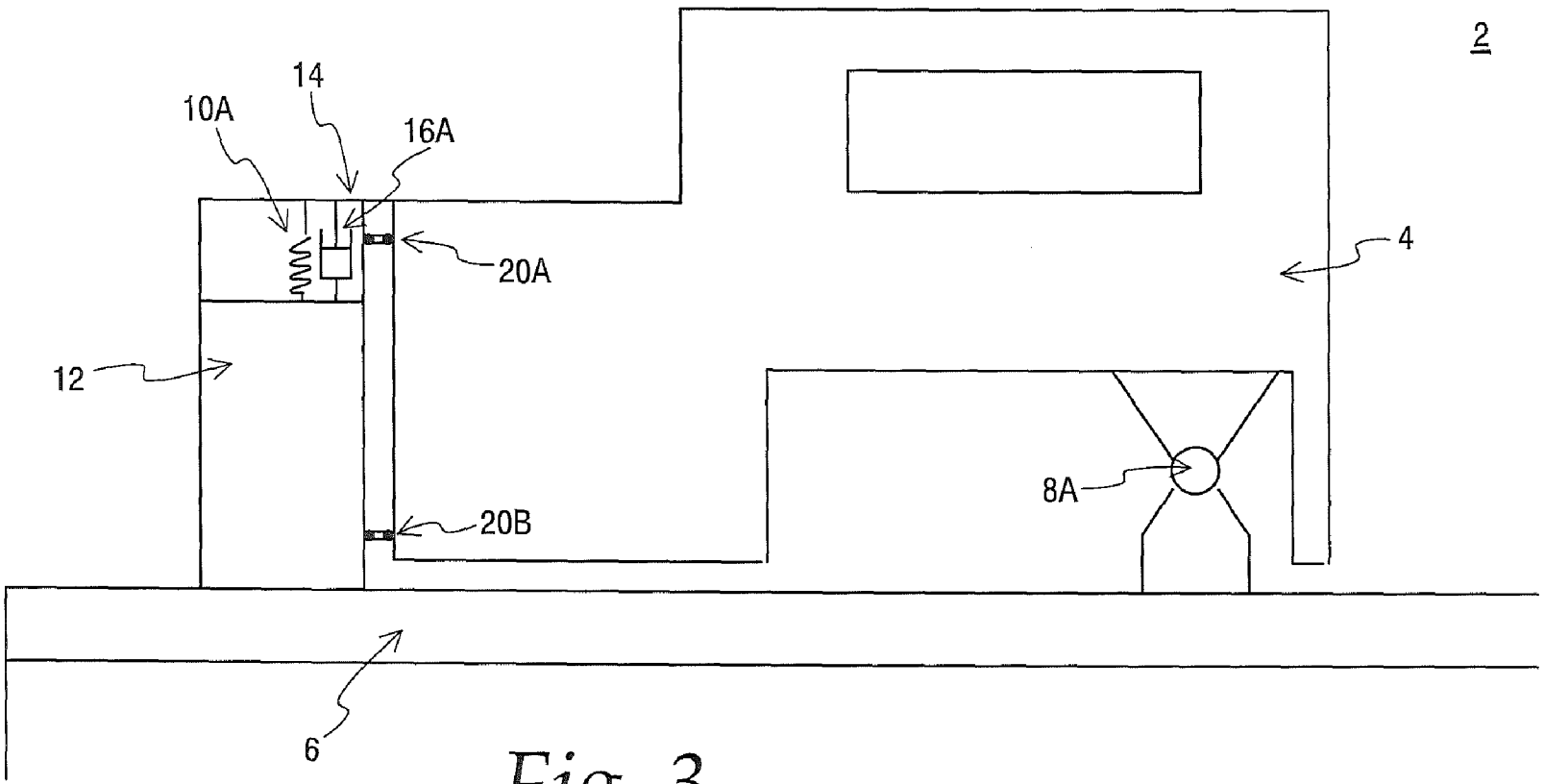
FIG. 3 is a conceptual illustration of a side view of a cab isolation system in accordance with another embodiment of the present invention.
Figure 4:
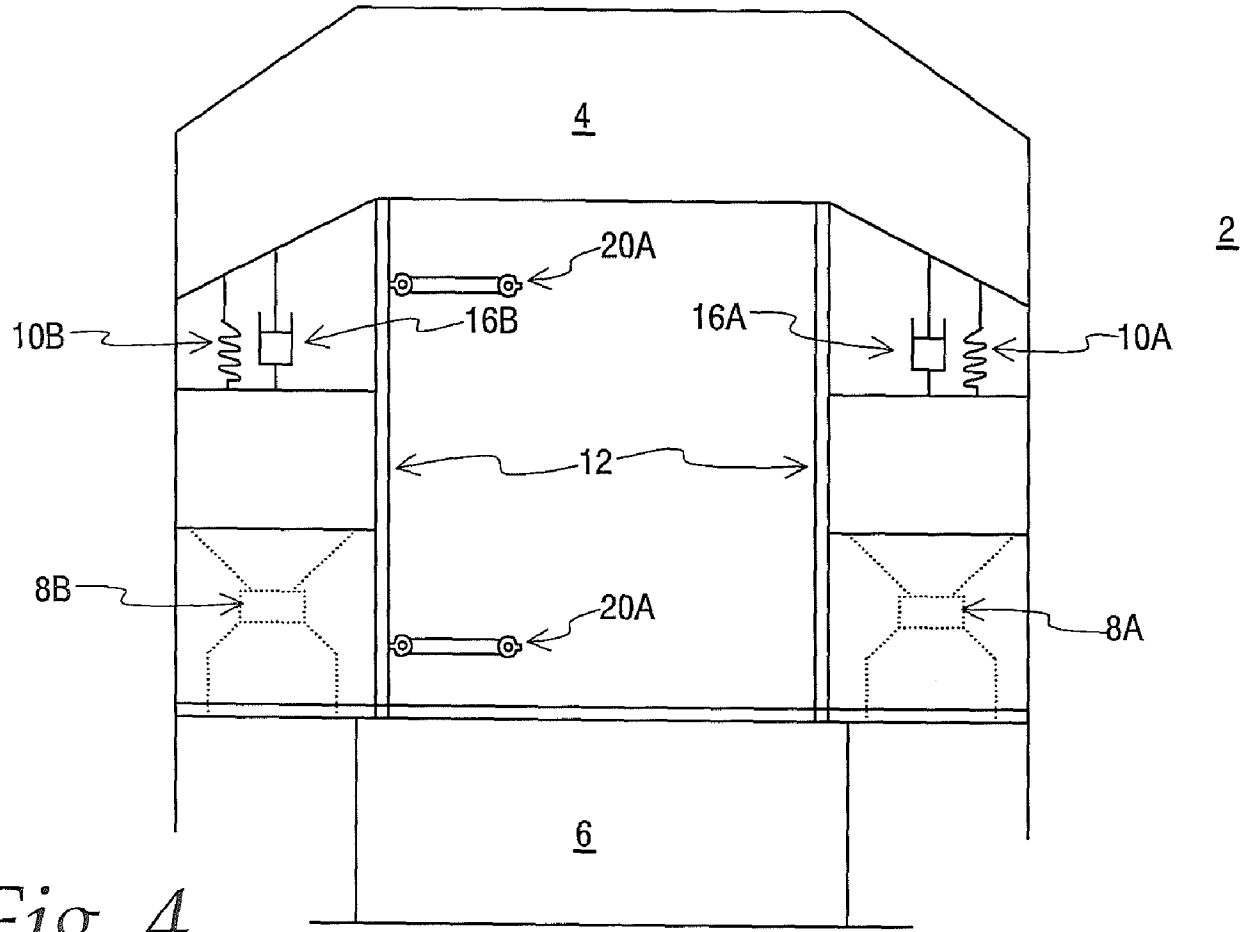
FIG. 4 is a front view of the cab isolation system of FIG. 3.

In yet another aspect of the present invention as shown in FIGS. 3 and 4, further included in the cab isolation system are lateral links 20*a*, 20*b* located near the front of the locomotive cab. The lateral links 20*a*, 20*b* may be adapted such that they are free to rotate at each end, but are stiff laterally. Such an arrangement allows for vertical and longitudinal motion, but restricts lateral motion, thereby also controlling yaw natural frequencies of the cab. Alternatively, the springs as discussed in the previous embodiments may be selected to control the yaw stiffness of the cab in place of the lateral links.

FIGS. 5 to 15 illustrate an embodiment which implements the concepts as described with respect to FIGS. 1 to 4. As shown in FIGS. 5 to 9, rear pivots 108*a*, 108*b* are provided near the rear of the cab 104. The rear pivots 108*a*, 108*b* are shown to be slanted outboard to provide lateral stiffness. In one example as shown specifically in FIG. 6, the rear pivots 108*a*, 108*b* may be slanted outboard at an angle of about 20 degrees. The rear pivots 108*a*, 108*b* may further be selected to be relatively stiff in the vertical and longitudinal directions, but relatively soft in the rotation direction. As specifically shown in FIGS. 8 and 9, the rear pivots 108, 108*b* may be bar mount type bushings which may be adapted to drop into a clevis in the cab brackets and mounted to a post extending from the underframe 106.

Figure 10:
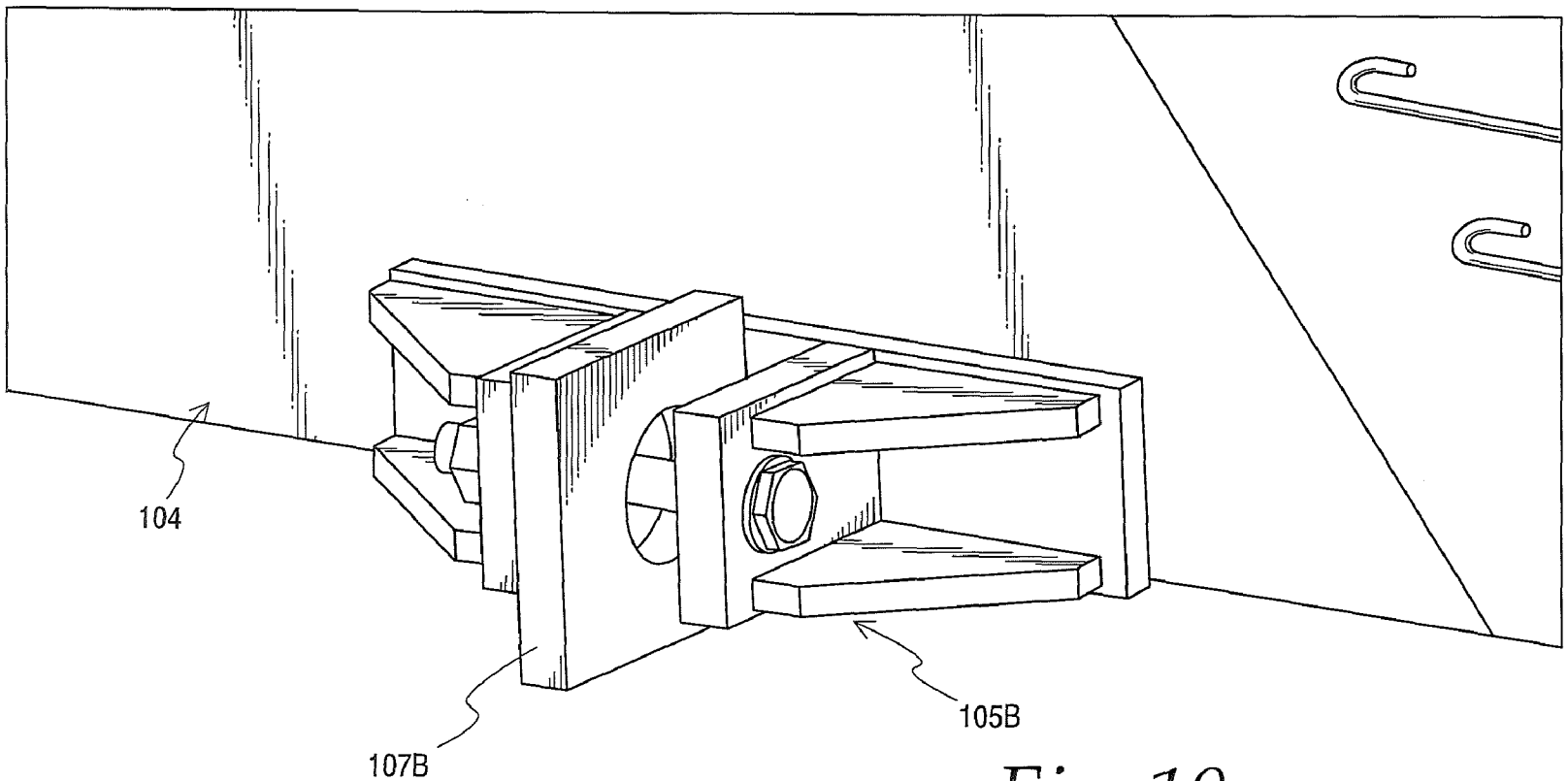
FIG. 10 is a perspective view of an embodiment of an interlock bracket for the cab isolation system of FIG. 5.

As shown in FIGS. 5 to 7, and FIG. 10, the cab 104 may further include interlock brackets 105*a*, 105*b* which engage the underframe. As shown in FIG. 10, the interlock bracket may include bolt which engages a flange (e.g., 107*b*) mounted to the underframe. The flange (e.g., 107*b*) may define an aperture sized such that it allows the bolt and, therefore, the cab to move freely when the locomotive is in motion under normal conditions. Upon an abnormally strong force (e.g., a collision), however, the bolt of the interlock brackets 105*a*, 105*b* engages the flange to prevent the cab from detaching from the underframe.

Figure 5:
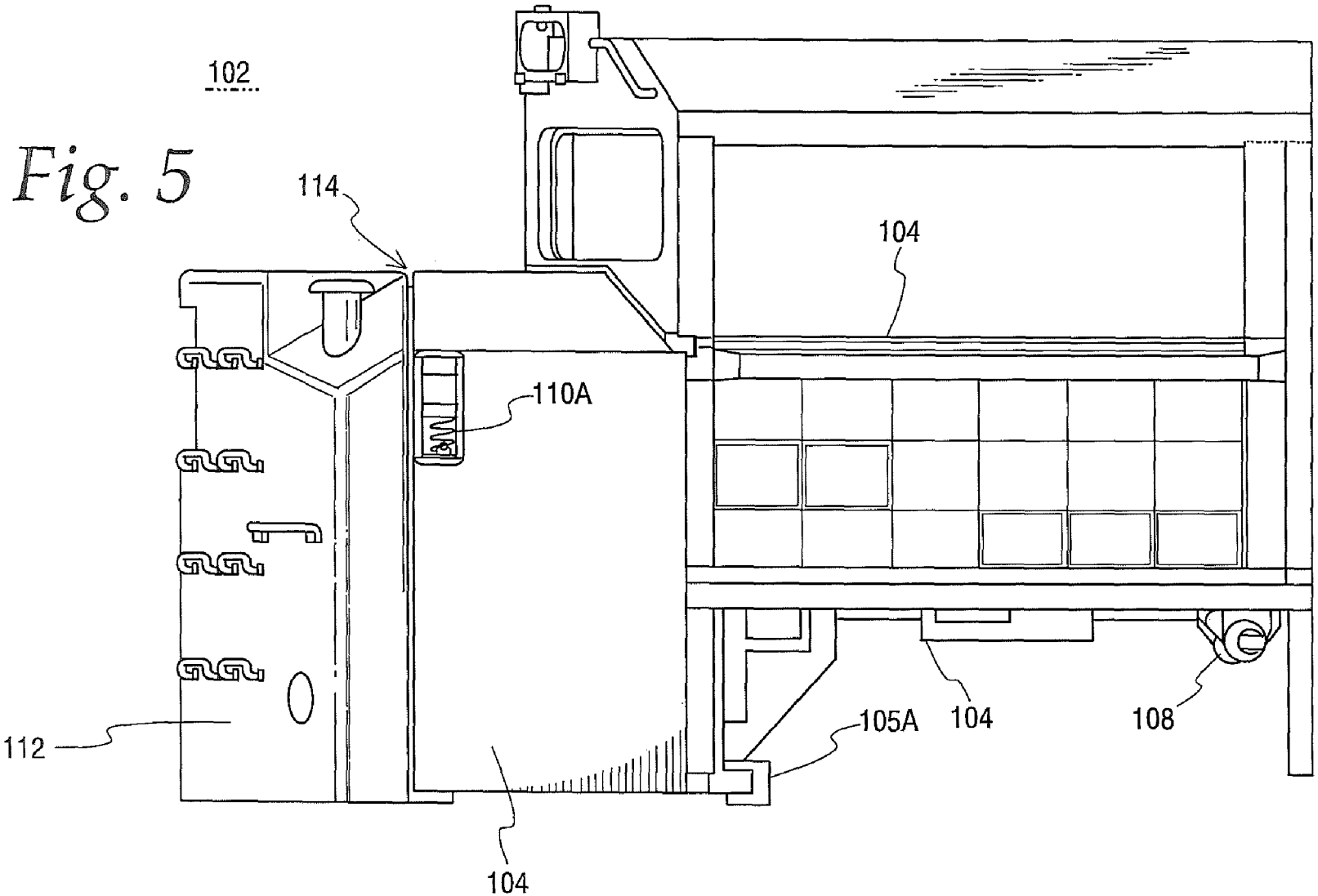
FIG. 5 is a side view illustrating an embodiment of the present invention which implements the concepts of the cab isolation system as described with respect to FIGS. 1 to 4.
Figure 11:
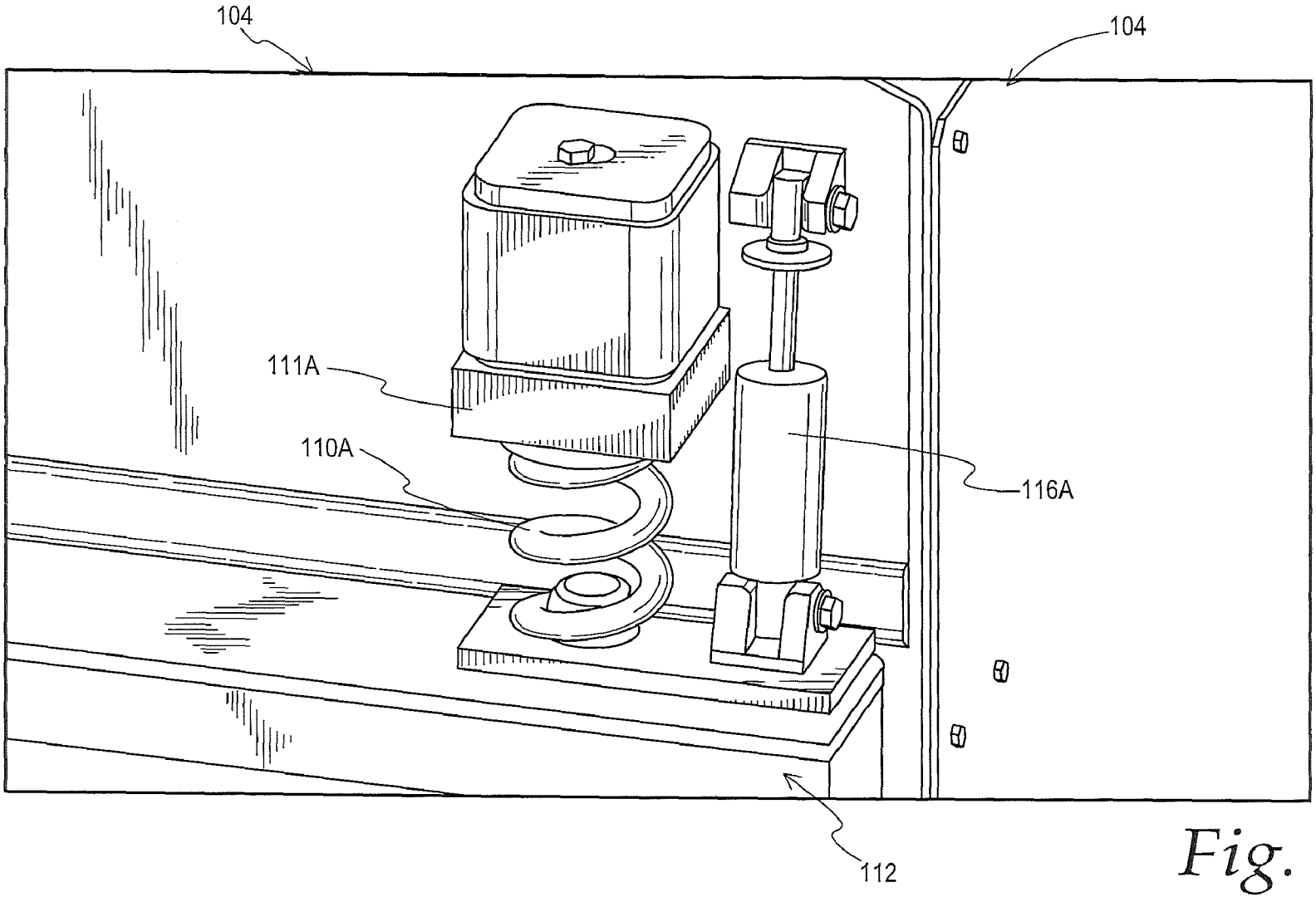
FIG. 11 is a perspective view of an embodiment of a front spring and a damper for the cab isolation system of FIG. 5.

As shown in FIGS. 5 and 11, front springs 110*a*, 110*b* are shown operatively engaged to the cab 104 via bracket 111*a* and mounted to short hood 112. In this arrangement, the pitch natural frequency is set by the stiffness of front springs 110*a*, 110*b*. The cab height may optionally be set by placing shims (not shown) above and/or below each of the front springs 110*a*, 110*b*. Dampers 116*a*, 116*b* are further shown operatively engaging short hood 112 and the cab 104. In this arrangement, damping is provided to limit magnification of low frequency suspension modes, and to prevent excessive magnification of the cab pitch, should there be any excitation at that frequency.

Figure 6:
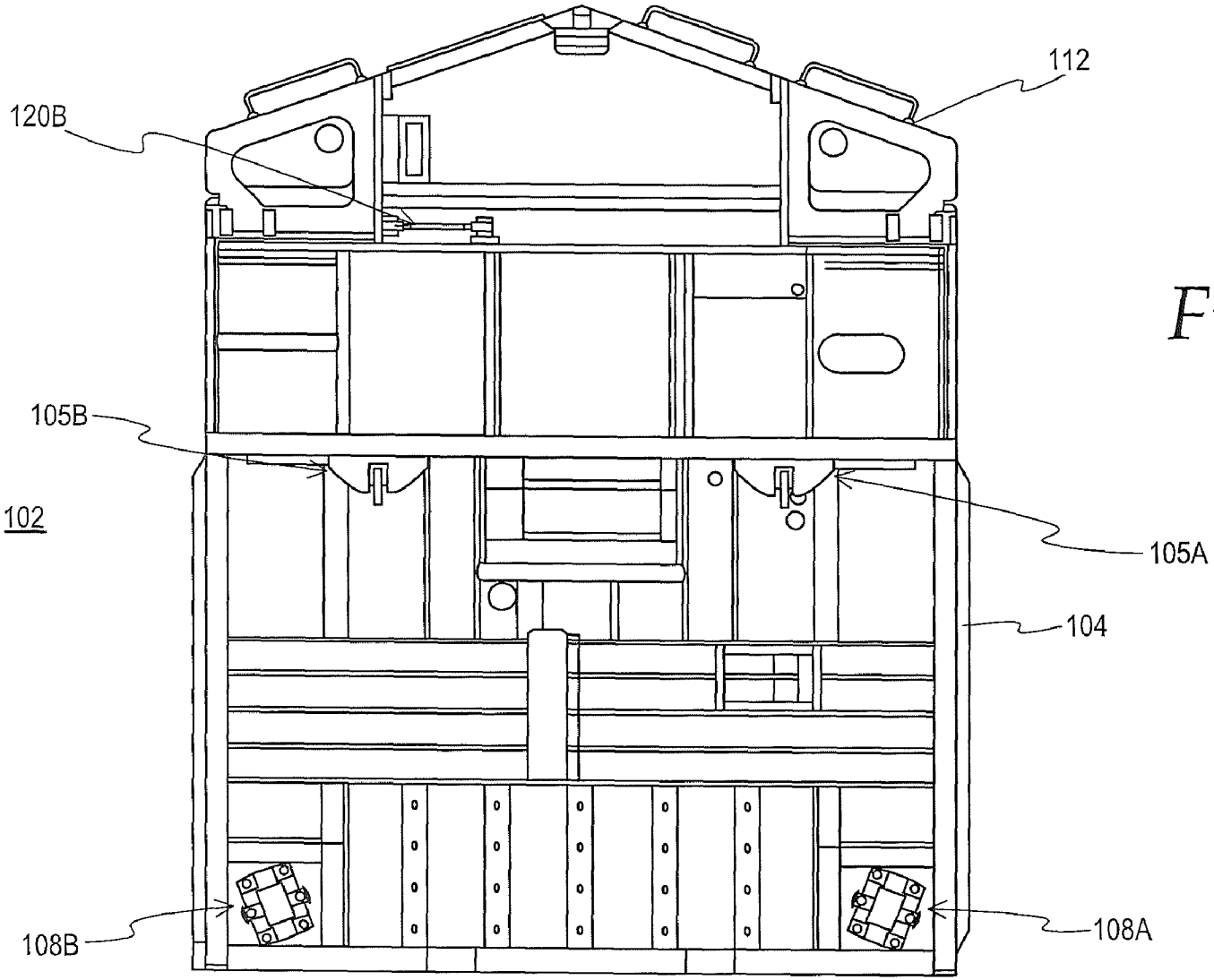
FIG. 6 is a bottom view of the cab isolation system of FIG. 5.
Figure 7:
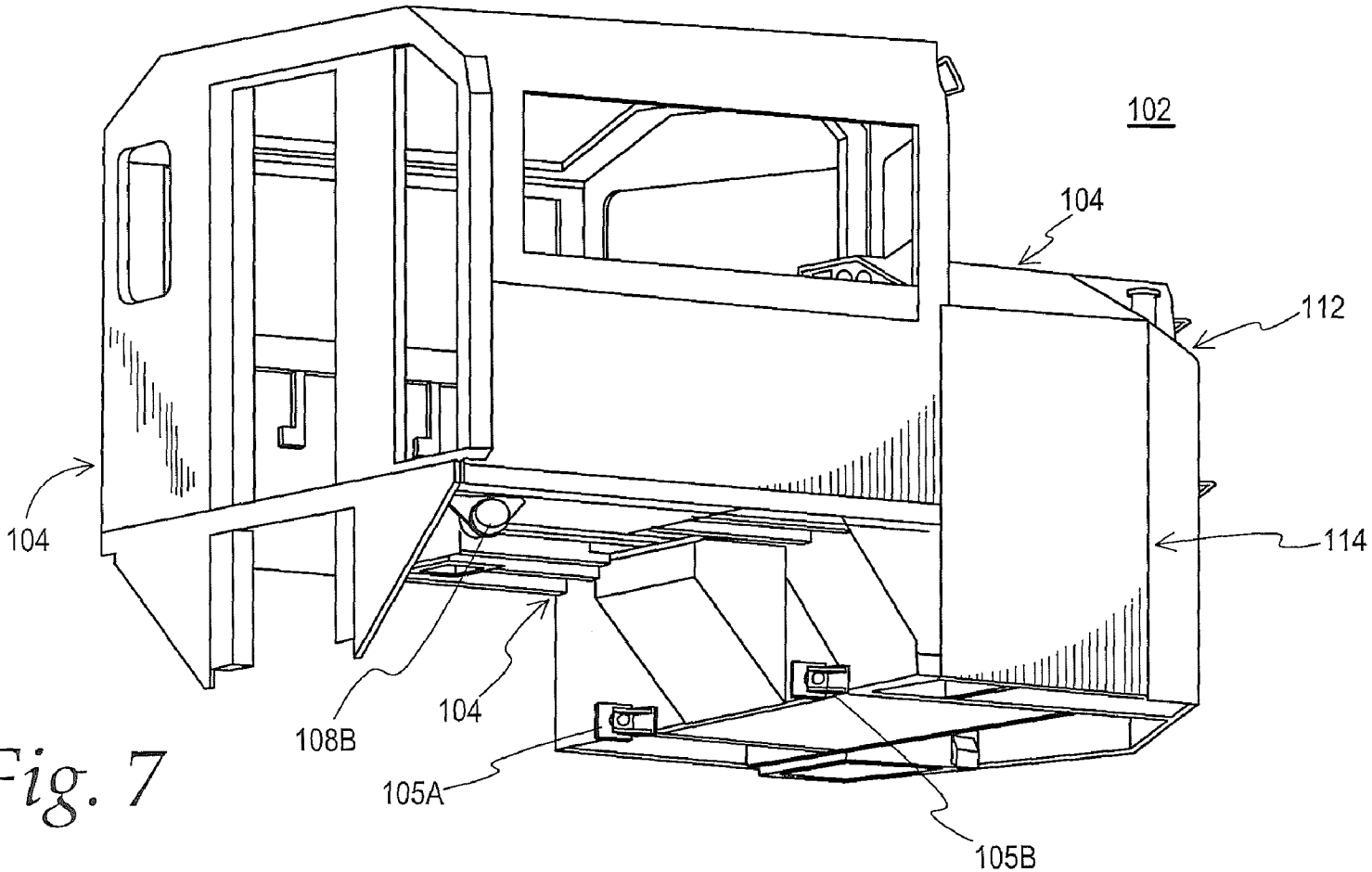
FIG. 7 is a perspective view of the cab isolation system of FIG. 5.
Figure 8:
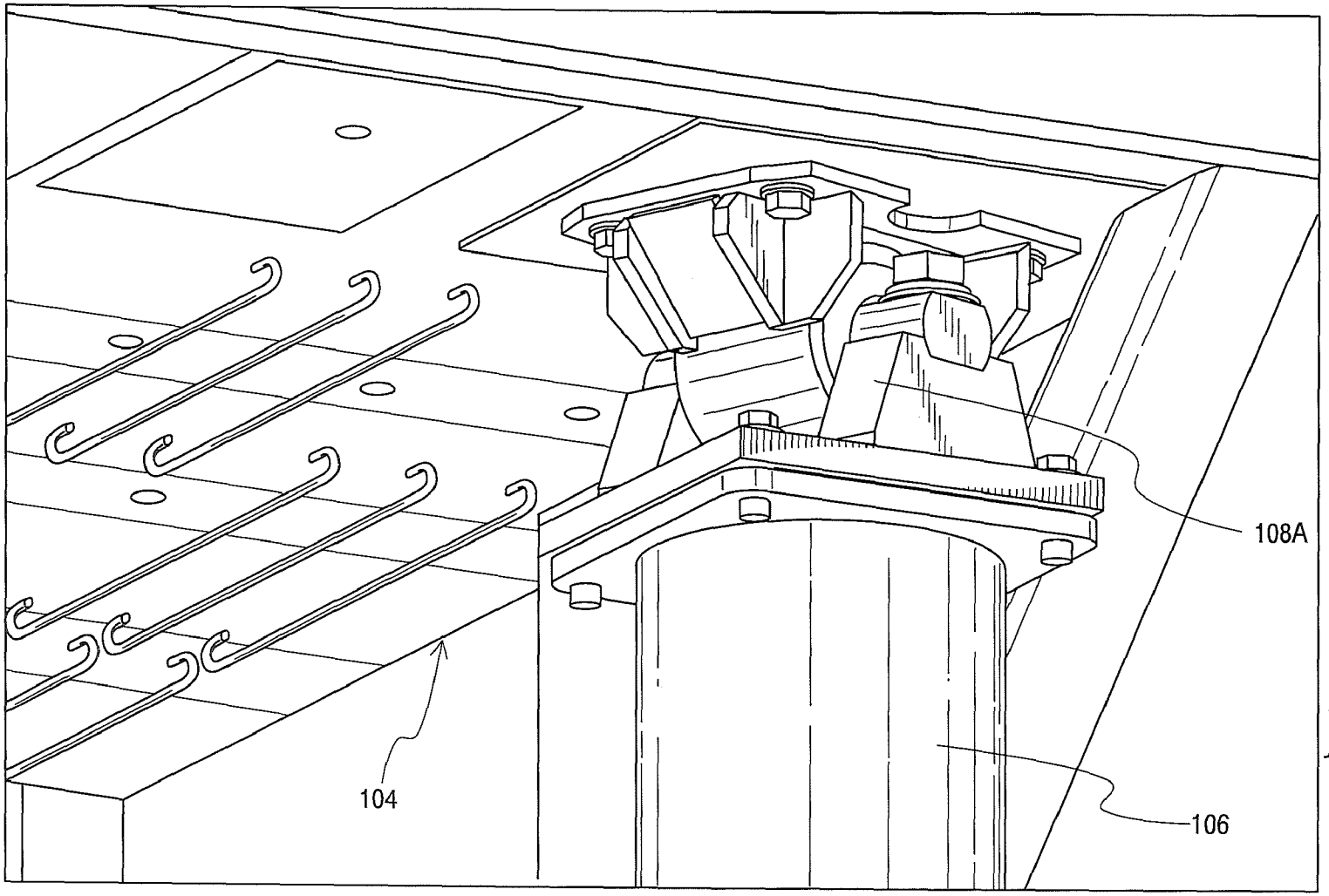
FIG. 8 is a perspective view of an embodiment of a rear pivot for the cab isolation system of FIG. 5.
Figure 9:
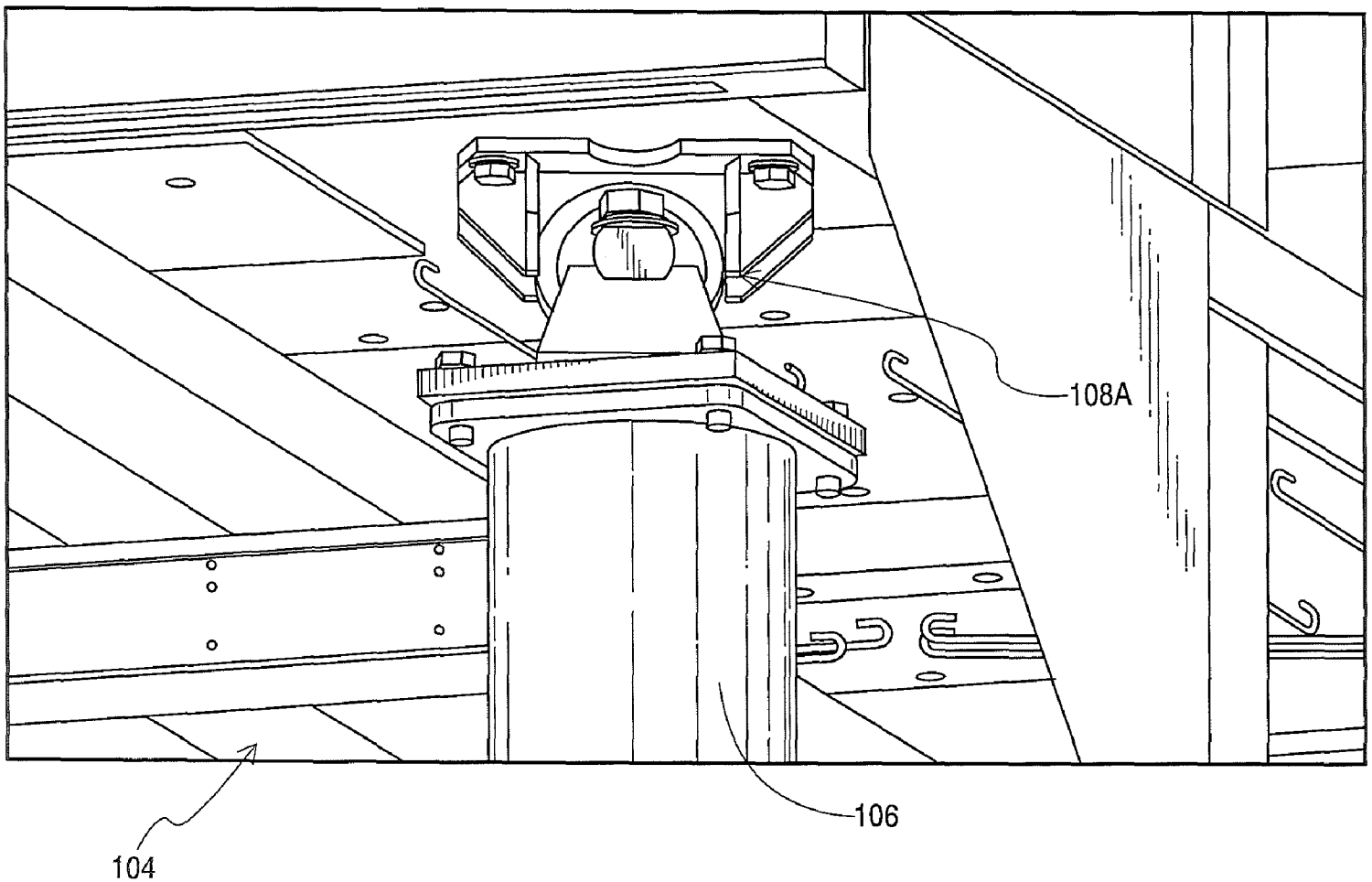
FIG. 9 is another perspective view of the rear pivot of FIG. 8.
Figure 12:
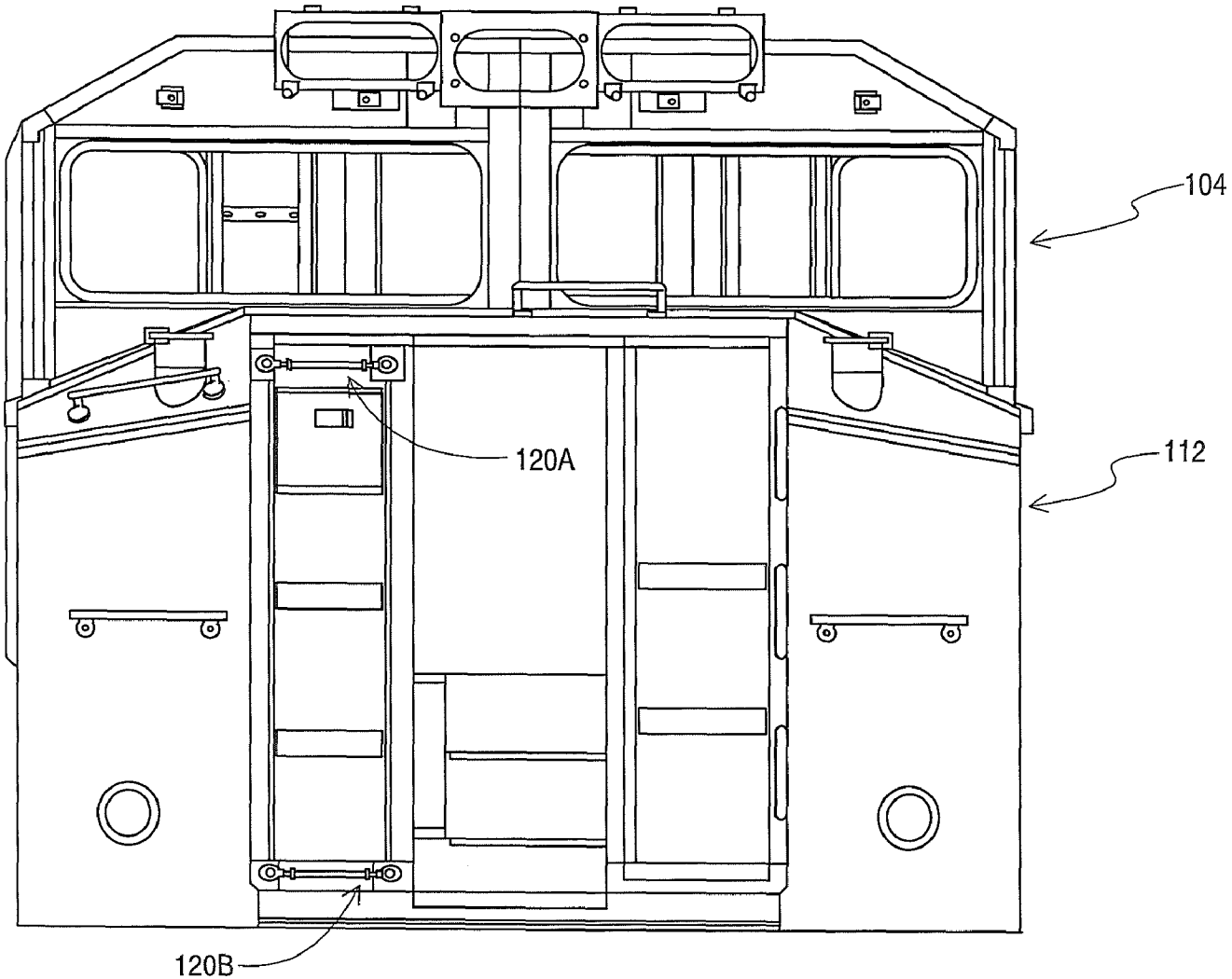
FIG. 12 is a front view of the cab isolation system of FIG. 5 showing an embodiment of lateral links.
Figure 13:
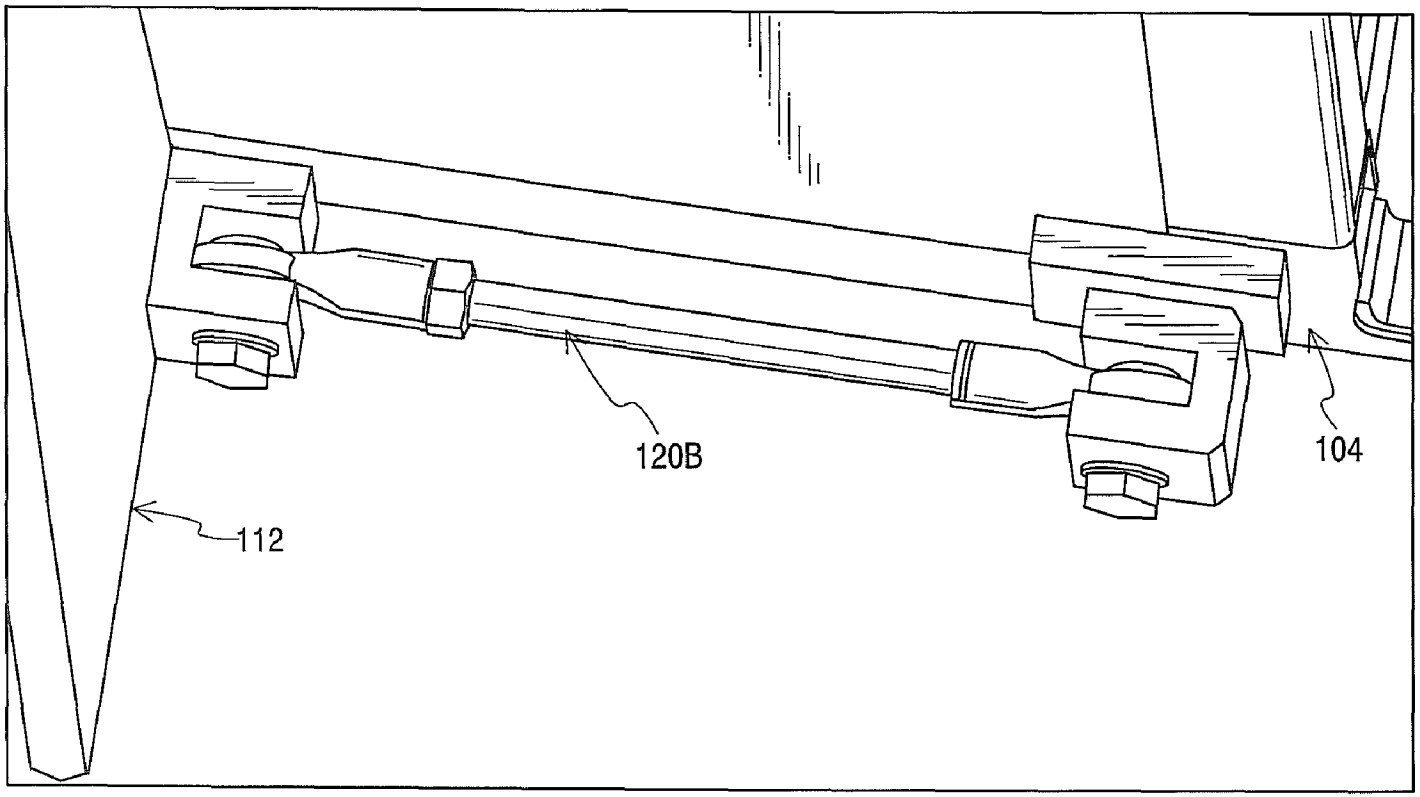
FIG. 13 is a perspective view of one of the lateral links of FIG. 12.

In yet another aspect of the present invention as shown in FIGS. 6, 12 and 13 further included in the cab isolation system are lateral links 120*a*, 120*b* located near the front of the locomotive cab. The lateral links may be adapted such that they are free to rotate at each end, but are stiff laterally. Such an arrangement allows for vertical and longitudinal motion, but restricts lateral motion, thereby also controlling yaw natural frequencies of the cab.

Figure 14:
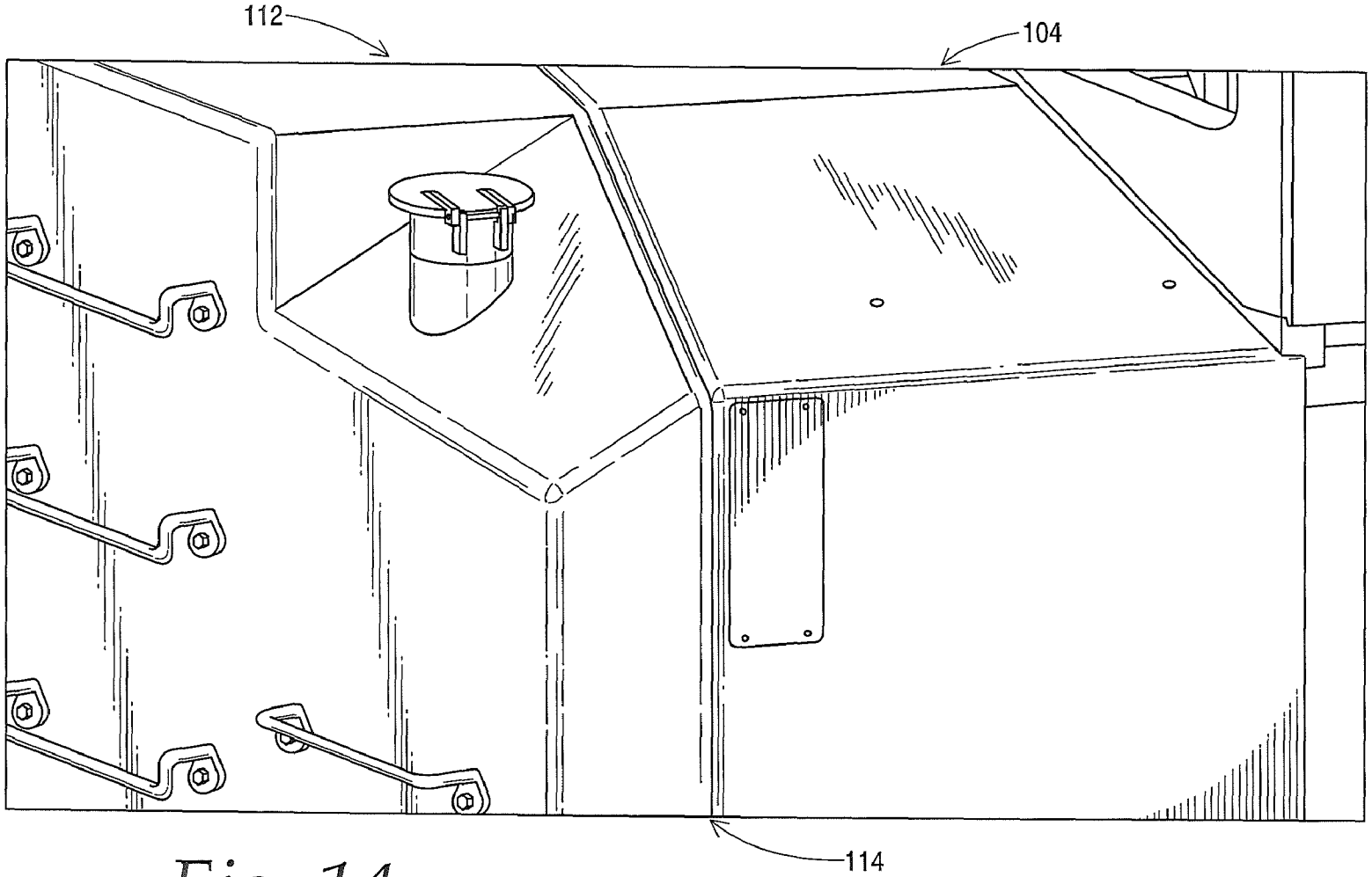
FIG. 14 is a perspective view of the cab isolation system of FIG. 5 showing an embodiment of a slip joint between the cab and the short hood.
Figure 15:
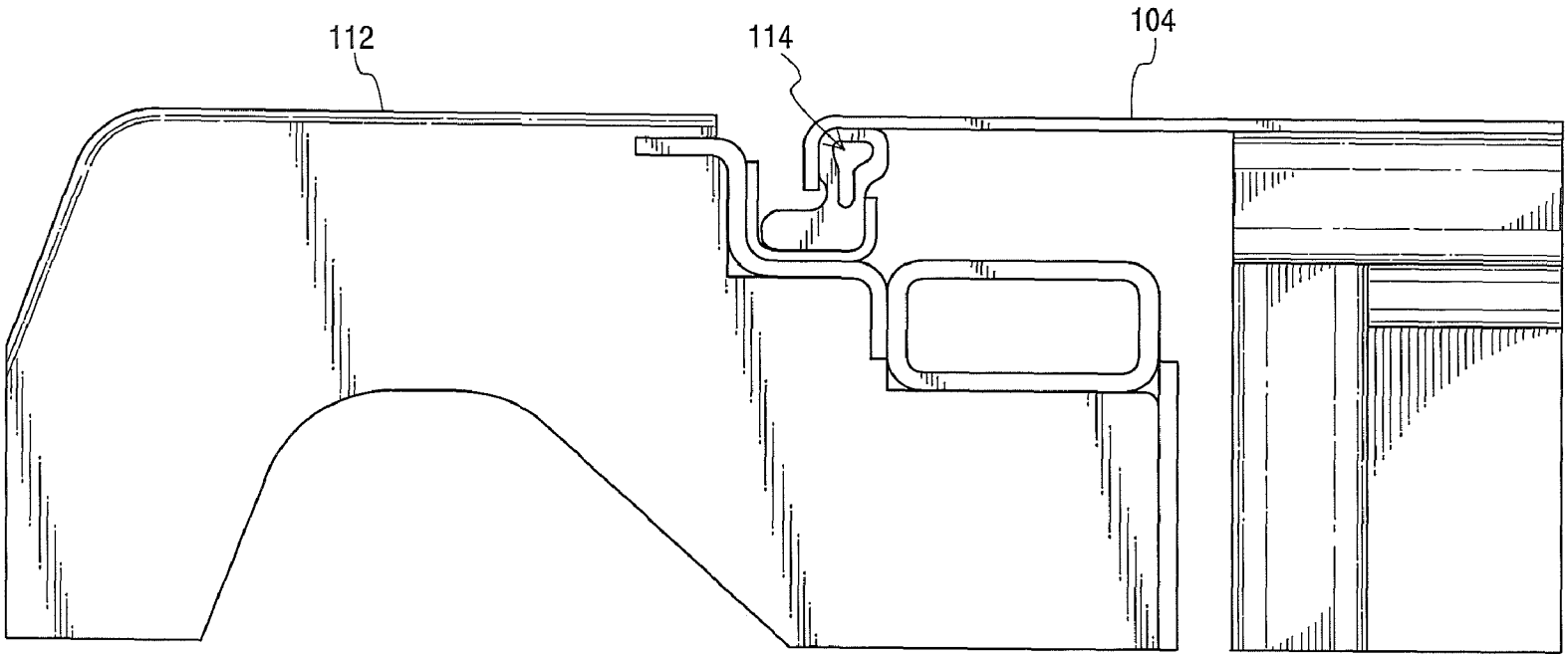
FIG. 15 is a sectional view showing the slip joint of FIG. 14.

In yet another embodiment as shown in FIGS. 5, 14 and 15, the short hood 112 and cab 104 are interconnected through a link in the form of a slip joint 114. The slip joint 114 further includes a seal between the engagement of the short hood 112 and the cab 104. The slip joint 114 provides for the relative motion between the cab 104 and the short hood 112 while giving the assembly an aesthetically finished look.

While this invention has been described with reference to certain illustrative aspects, it will be understood that this description shall not be construed in a limiting sense. Rather, various changes and modifications can be made to the illustrative embodiments without departing from the true spirit, central characteristics and scope of the invention, including those combinations of features that are individually disclosed or claimed herein. Furthermore, it will be appreciated that any such changes and modifications will be recognized by those skilled in the art as an equivalent to one or more elements of the following claims, and shall be covered by such claims to the fullest extent permitted by law.

What is claimed is:

1. A cab isolation system for a locomotive including a cab having a front and a rear, an underframe, and a short hood engaging the front of the cab and situated on the underframe, said cab isolation system comprising:

at least one pivot operatively engaging the rear of the cab to the underframe, said pivot selected to control the frequency and magnitude of vertical, lateral and longitudinal natural frequencies near the rear of the cab, and at least one spring operatively engaging the front of the cab to the underframe via a least a portion of the short hood, wherein said spring engages the portion of the short hood above the longitudinal plane of the engagement of the pivot and the underframe, wherein a cab pitch natural frequency is established by the spring between the cab and the short hood, said spring selected to maintain a lower cab pitch natural frequency relative to the underframe first bending natural frequency, wherein the pivot and spring are situated to isolate the cab from the first bending natural frequency of the underframe.

2. The cab isolation system of claim 1, wherein the pivot is a bushing.

3. The cab isolation system of claim 1, wherein the pivot is relatively stiff in the vertical, lateral and longitudinal directions relative to the rotation direction.

4. The cab isolation system of claim 1, wherein the spring is selected from the groups consisting of a steel coil spring, a leaf spring, a rubber spring, composite spring, and an airbag.

5. The cab isolation system of claim 1, wherein the spring controls vertical motion.

6. The cab isolation system of claim 1, wherein the first bending natural frequency of the underframe is about 5.2 Hz.

7. The cab isolation system of claim 1, further comprising a damper operatively engaging the front of the cab to the underframe, said damper reducing magnification of low frequency motions.

8. The cab isolation system of claim 1, wherein the spring provides damping properties.

9. The cab isolation system of claim 1, further comprising a lateral link, said lateral link located near the front of the cab.

10. The cab isolation system of claim 9, wherein the lateral link includes a first and second end and wherein the link is free to rotate at each end.

11. The cab isolation system of claim 9, wherein the lateral link is stiff laterally.

12. The cab isolation system of claim 9, wherein the lateral link controls yaw natural frequencies of the cab.

13. The cab isolation system of claim 7, wherein the spring and damper are both coupled to a bracket which provides an engagement between the cab and the underframe.

14. The cab isolation system of claim 1, wherein the spring is located in the short hood.

15. The cab isolation system of claim 7, wherein the damper is located in the short hood.

16. The cab isolation system of claim 1, wherein the spring is selected to control the yaw stiffness of the cab.

17. The cab isolation system of claim 1, wherein the spring stiffness is selected to maintain a cab pitch natural frequency of about 3.5 Hz.

18. The cab isolation system of claim 1, wherein the locomotive further includes a bogie suspension having select frequencies and the spring stiffness is selected to maintain a cab pitch natural frequency below the bogie suspension frequencies.

19. The cab isolation system of claim 1, wherein the spring stiffness is selected to maintain a cab pitch natural frequency below track input frequencies.

20. The cab isolation system of claim 1, further comprising at least one interlock bracket for securing the cab to the underframe, said interlock bracket being adapted to allow cab movement relative to the underframe.

* * * * *